United States Patent [19]

Randall

[11] 4,282,607

[45] Aug. 11, 1981

[54] DISPOSABLE-TYPE CAP WITH PULL-OUT CROWN

[75] Inventor: James E. Randall, Worthington, Ohio

[73] Assignee: Kap & Kor, Inc., Cleveland, Ohio

[21] Appl. No.: 122,874

[22] Filed: Feb. 20, 1980

[51] Int. Cl.[3] ..... A42B 1/22
[52] U.S. Cl. ..... 2/197
[58] Field of Search ..... 2/197, 195, 196, 175

[56] References Cited

U.S. PATENT DOCUMENTS

| | | | |
|---|---|---|---|
| 3,550,160 | 12/1970 | Gruber | 2/197 |
| 4,186,446 | 2/1980 | Maney | 2/197 |

*Primary Examiner*—Peter P. Nerbun
*Attorney, Agent, or Firm*—William S. Rambo

[57] ABSTRACT

A disposable-type hat or cap features a circumferential headband and a pleated, accordion-like crown portion marginally attached to inner surfaces of the headband. The crown is fashioned so that it may be either recessed within or elevated above the headband and is provided with an adjustable portion to permit head size adjustment of the headband.

2 Claims, 6 Drawing Figures

FIG. 4
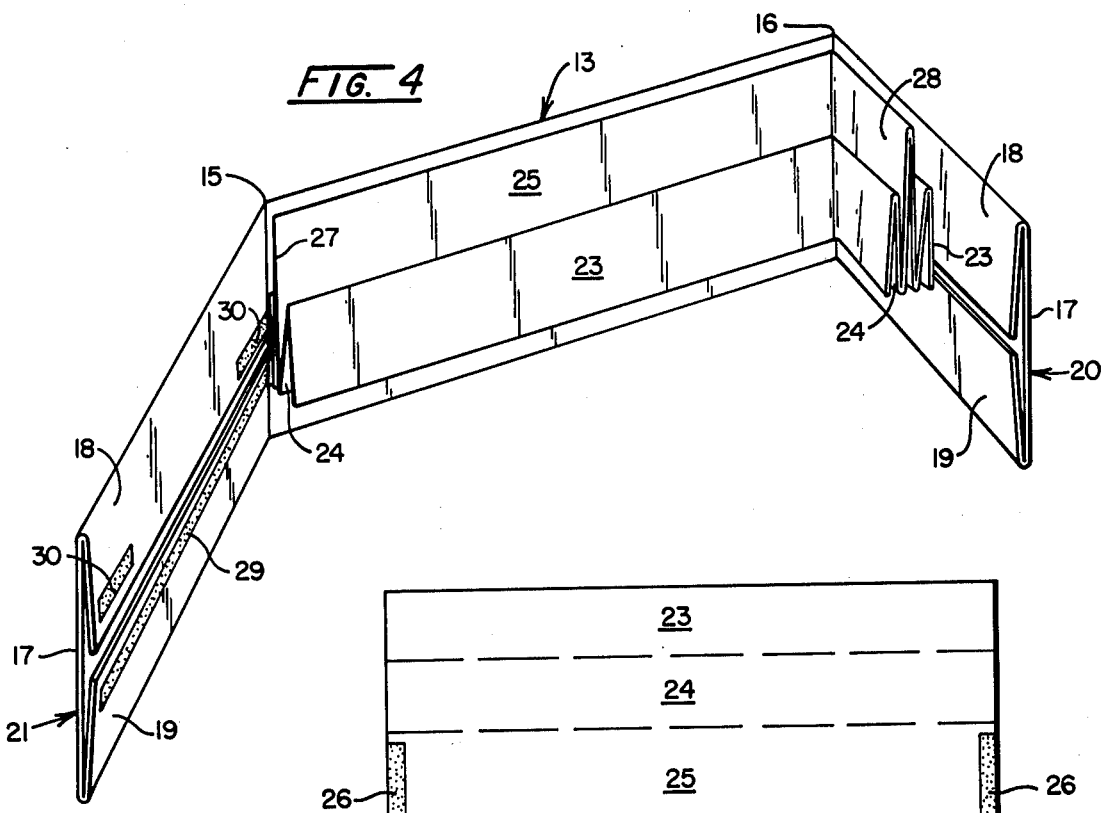
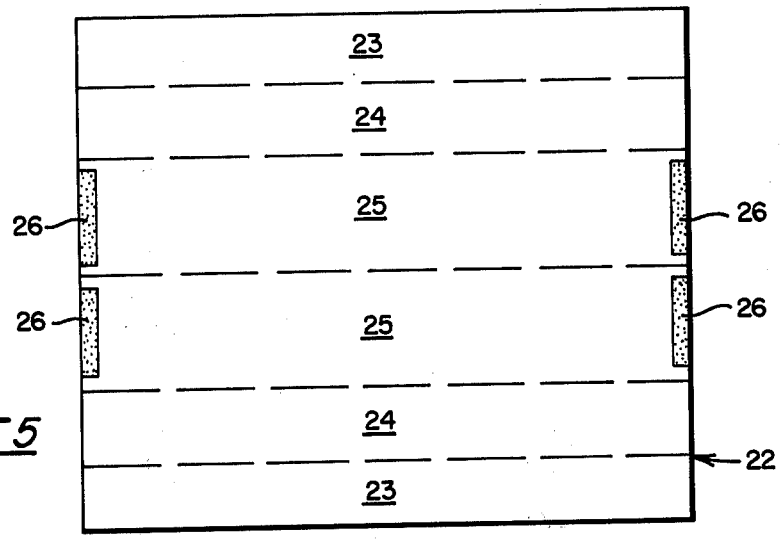
FIG. 5
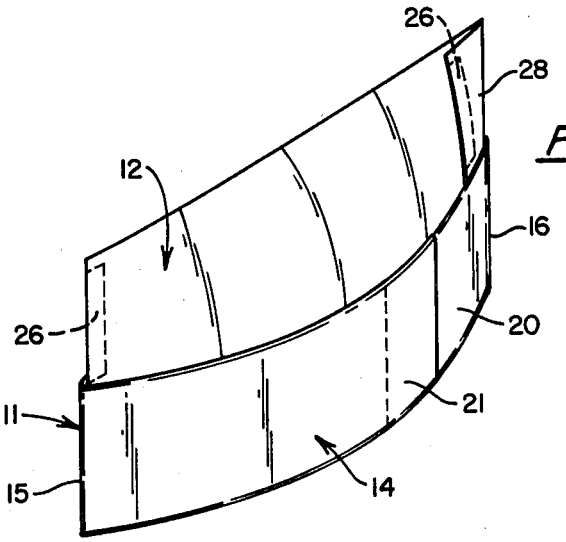
FIG. 6

DISPOSABLE-TYPE CAP WITH PULL-OUT CROWN

BACKGROUND OF THE INVENTION

The present invention relates to disposable caps, and more particularly to a military or overseas-style disposable cap.

Hygenic, throw-away headgear, commonly worn by food service personnel, is available in a variety of styles. Two popular configurations are the overseas style, peaked-crown cap and the butcher's flattened-crown cap. Basically, the overseas style cap comprises an oval or elliptical headband having front and rear end folds and a crown attached to the headband and projecting above it and defining peaks at each end of the cap. The butcher's cap has a headband similar to that of the overseas cap, but the crown is usually within the confines of the headband and is flattened against the wearer's head. As generally indicated in the prior art, the crown portion of the butcher's cap has the advantage of folding flatly within the headband when the cap is not in use, thereby facilitating storage and shipment. The crown of the overseas cap, on the other hand, is comparatively larger and more bulky, but the peaked crown is generally preferred because of its jaunty appearance.

U.S. Pat. No. 3,390,405 issued July 2, 1968 to Gruber exemplifies the flattened crown, butcher style, disposable cap. The Gruber patent discloses a crown portion which expands and contracts laterally within the confines of the headband along a series of accordion-like pleats. The opposite, longitudinal sides of the crown are adhesively secured to opposite inner sides of the headband, and the front and rear ends of the crown substantially align with the front and rear end folds of the headband.

Owing to its construction, however, the Gruber cap cannot escape its flattened-crown configuration. The cap relies on the end folds of its headband to pinch and maintain the ends of the crown in a folded closed condition which prevents the pleats of the crown from unfolding into an upwardly projecting, peaked configuration.

U.S. Pat. No. 2,685,090 issued Aug. 3, 1954 to Wagenfeld discloses an overseas or peaked-style cap having a crown which may be everted or folded within the surrounding headband when the cap is to be packaged or stored. The crown material of the Wagenfeld cap is coextensive with the headband strip and is attached to the elongated headband material by pinching its lower longitudinal edge between two plys of the upper longitudinal edge of the headband. The vertical ends of the headband strip and the attached crown material are brought together, and the adjoining portions of the upper longitudinal edge of the crown are sewn together to close the crown along a central peak or upper stem. Thus, when the crown of the Wagenfeld cap is elevated no gaps can develop at the front or rear ends, since the crown material is coextensive with the longitudinal headband strip. The Wagenfeld crown, however, is stitched and closed along an upper, central seam and this limits and impedes the head size adjustability of the cap. Further, the crown of the Wagenfeld cap is not designed to be worn in a flat, butcher style, but is limited to a peaked, overseas style of cap when worn.

SUMMARY OF THE INVENTION

The disposable cap disclosed herein includes a headband having a pair of side panels joined by front and rear end folds and a crown formed from a single sheet of flexible material having opposite side and end edges. The crown sheet is folded longitudinally on itself to define a pair of outer side panels and a plurality of relatively expansible intermediate pleats, and the outer panels of the crown are adhesively secured to the inner surfaces of the headband side panels. The gist of the invention is a pair of longitudinally extending, central crown panels which are adjacent to each other and lie between the intermediate pleats of the crown. The central panels are adjustable between relatively elevated and retracted positions with respect to the headband and thereby vary the style of the crown from the butcher's skull-type to the overseas peaked-type. Furthermore, the end edges of the central crown panels are secured together, so that gaps do not appear in the front and rear ends of the crown when it is raised above the headband. The present disposable cap also provides an adjustable crown which includes a variable length, folded-back crown portion adjacent one of the end folds of the headband which permits the crown to be expanded when the associated headband is adjusted to a larger size.

The main object of the present invention is to provide a disposable cap having a crown that may be recessed between the side walls of the headband when stored or shipped and that may be elevated above the headband into an attractive, overseas style for use.

Another object is to provide a disposable cap that is economical and relatively simple to construct, that lends itself to construction by automatic machine processes, and that is durable and sturdy.

BRIEF DESCRIPTION OF THE DRAWINGS:

FIG. 4 is a perspective view of the cap in an intermediate stage of assembly and showing the relatively telescoping end flaps of the headband prior to their relative, interfitting engagement;

FIG. 5 is a plan view of the crown blank prior to its folding and securement to the headband; and FIG. 6 is a perspective view of the cap with its crown elevated.

Figure 1:
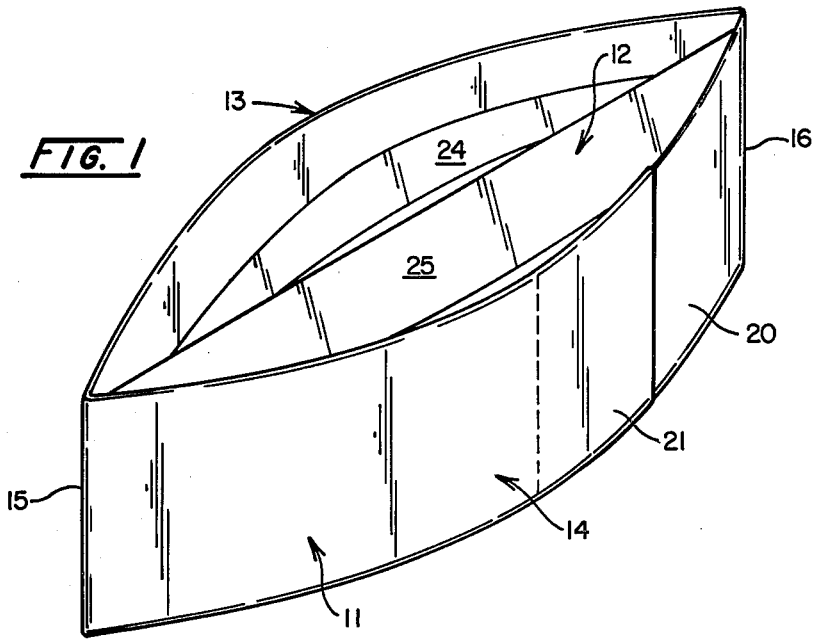
FIG. 1 is a perspective view of a disposable cap according to this invention and showing the crown in its inwardly folded, retracted position.
Figure 3:
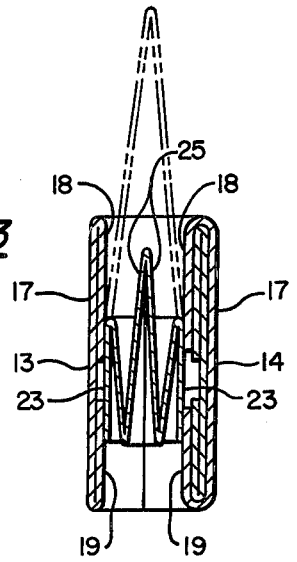
FIG. 3 is a cross-sectional view of the cap taken approximately along the line 3—3 of FIG. 2.
Figure 2:
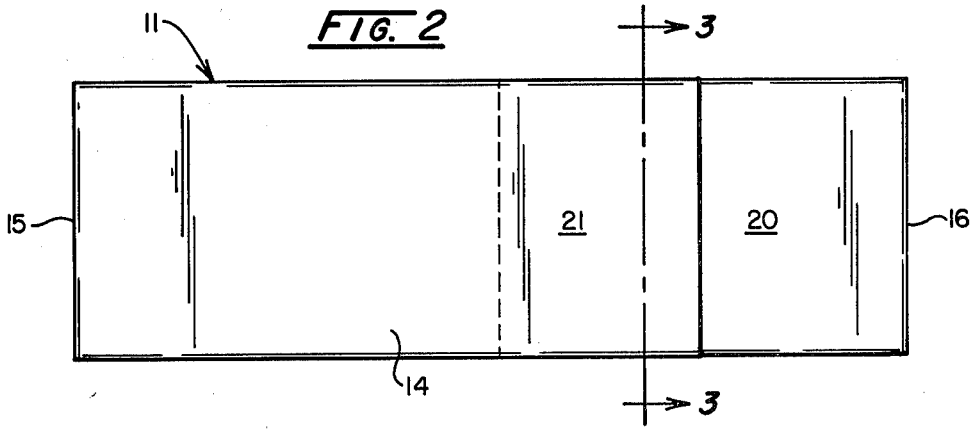
FIG. 2 is a side elevation view of the cap with the crown occupying a retracted position within the headband.

DETAILED DESCRIPTION OF THE PREFERRED EMBODIMENT:

As illustrated particularly in FIGS. 1 and 6, the present disposable cap comprises generally a headband 11 and a crown 12 which may be adjusted between a relatively retracted position within the confines of the headband and a relatively extended, peaked position in which it projects upwardly above the headband, as indicated by broken lines in FIG. 3. The headband 11 is preferably fabricated from a relatively heavy, textured paper, while the crown 12 is preferably formed from a comparatively lightweight tissue or crinoline-like paper. Other substances, such as flexible synthetic resin film or sheet material, may also be used to form the headband and/or crown portions of the cap.

The headband 11 is substantially indentical in its construction to the headband described and claimed in my prior copending application Ser. No. 069,876 filed Aug. 27, 1979. The headband comprises a pair of opposed, double thickness side panels 13 and 14 which are joined by vertical front and rear end folds 15 and 16, respectively. Each of the side panels 13 and 14 includes a continuous, vertically arranged outer ply or wall 17, a downturned upper hem 18 and an upturned lower hem 19. The side panel 13 is continuous between the front and rear end folds 15 and 16, whereas the side panel 14 is made up of a pair of relatively telescoping male and female end flaps 20 and 21, respectively. The side panel 14 is thus adjustable in length by sliding the male end flap 20 inwardly or outwardly of the female end flap 21. Adjustment in the length of the side panel 14 varies the head size of the headband 11 to accommodate the cap to the varying head sizes of different wearers.

As shown particularly in FIG. 5, the crown 12 is made from a single, rectangular blank 22 of flexible sheet material having a series of relatively spaced, parallel, longitudinally extending fold lines. The fold lines of the crown blank 22 are arranged to define a pair of outer side panels 23, a pair of intermediate pleats 24 and a pair of centrally disposed, peak-forming panels 25. Prior to its attachement to the inner side of the headband, the crown blank 22 is folded in accordion-like fashion into the configuration shown in FIG. 3, and the end portions of the central peak-forming panels 25 of the crown are adhesively joined by glue laps 26 (see FIG. 5). As shown in FIG. 4, the longitudinally folded crown 12 is substantially longer than the side panel 13 of the headband 11 and is arranged so that its forward end 27 is substantially flush with the forward end fold 15 of the headband 11 and its rearward end portion overlaps and extends a distance beyond the rear end fold 16 of the headband to provide a head size adjustment pleat or fold 28.

The outer side panels 23 of the crown are adhesively secured to the upper and lower hems 18 and 19 of the side panel 13 and the female end flap 21 of the headband by means of glue laps 29 and 30. As indicated in FIG. 4, the glue lap 29 is substantially continuous and extends substantially along the full lengths of the female end flap 21 and the side panel 13, but terminates a slight distance inwardly from the terminus of the expansion pleat 28. The glue laps 30, on the other hand, are preferably applied at relatively spaced apart intervals along the upper hem portion 18 of the female end flap 21 and side panel 13 of the headband, so that the crown 12 may have greater fullness in the areas thereof which lie between the glue laps 30.

Following the adhesive application of the longitudinally folded crown 12 to the upper and lower hems 18 and 19, the headband is folded along the end fold lines 15 and 16 and the male end flap 20 is inserted fully into the open end of the female flap 21. The finished cap is then in a substantially flat condition with the panels 23, 24 and 25 of the crown 12 disposed in tightly folded order between the opposite side panels 13 and 14 of the headband 11. In this flat condition, the cap may be conveniently packaged and stored with minimal volume.

In operation, the headsize of the cap may be easily adjusted to the head of a wearer simply by sliding the male end flap 20 in an outward direction from the female end flap 21 of the headband. This outward adjustment of the male end flap expands the circumferential dimension of the headband and at the same time decreases the area of the folded-over pleat 28 to thus also increase the volume defined by the crown 12 of the cap. If desired, the rear fold line 16 may be rearranged by recreasing the rear end of the headband in its expanded dimension.

As indicated from a comparison of FIGS. 1 and 6, the present cap may be worn in a butcher-style in which the crown 12 occupies a comparatively flattened position beneath the uppermost edge of the headband, or it may be worn in a peaked, overseas style in which the central panels 25 of the crown project upwardly a substantial distance above the headband 11. The transition from butcher-style to overseas style may be easily accomplished simply by pulling upwardly upon the central panels 25 of the crown while holding the headband in a round or oval shape. The upward pull upon the central panels 25 causes the intermediate pleats or panels 24 of the crown to evert, thus changing the cross-sectional configuration of the crown from the modified W-shape shown in full lines in FIGS. 1 and 3 to the elongated, inverted V-shape shown in FIG. 6 and by broken lines in FIG. 3. The folded-over expansion pleat 28 of the crown may also be extended upwardly with the remainder of the crown, since only the outer panel 23 of the pleat 28 which is disposed adjacent the male end flap 20 is adhered to the headband. The glue laps 26 effectively close and seal the opposite ends of the central panels 25 to prevent any unsightly gaps or openings at the ends of the crown.

In view of the foregoing, it will be seen that this invention provides a highly versatile, yet structurally simple disposable cap which may be easily converted from a flat crown, butcher style into a peaked crown, overseas style simply by lifting upwardly upon the central peak-forming panels of the crown.

While a single preferred embodiment of the invention has been illustrated and described in detail, it will be understood that various modifications in design and details of construction are possible without departing from the spirit of the invention or the scope of the following claims.

I claim:

1. In a disposable cap having a headband formed with inner and outer side surfaces, that improvement which comprises a crown consisting of a rectangular, flexible sheet having opposite side and end edges and folded longitudinally on itself to define a pair of outer side panels, a plurality of intermediate pleats and a pair of peak-forming panels, the outer side panels of said crown being secured to the inner side surfaces of said headband and the intermediate pleats and peak-forming panels of said crown being adjustable between relatively elevated and retracted positions with respect to said headband to vary the crown style of the cap; and means securing the end edges of the peak-forming panels only of said sheet to one another.

2. A disposable cap according to claim 1, wherein said sheet is also folded transversely upon itself to form a size adjustable pleat adjacent one end edge of said sheet.

* * * * *